US005261488A

United States Patent [19]

Gullet et al.

[11] Patent Number: 5,261,488

[45] Date of Patent: Nov. 16, 1993

[54] CENTRALIZERS FOR OIL WELL CASINGS

[75] Inventors: Paul D. Gullet, Grantham, Great Britain; Manfred Jansch, Garbsen, Fed. Rep. of Germany

[73] Assignee: Weatherford U.K. Limited, United Kingdom

[21] Appl. No.: 910,135

[22] PCT Filed: Jan. 17, 1991

[86] PCT No.: PCT/GB91/00065

§ 371 Date: Aug. 6, 1992

§ 102(e) Date: Aug. 6, 1992

[87] PCT Pub. No.: WO91/10806

PCT Pub. Date: Jul. 25, 1991

[30] Foreign Application Priority Data

Jan. 17, 1990 [GB] United Kingdom ..... 9001007
Jul. 28, 1990 [DE] Fed. Rep. of Germany ..... 4024000

[51] Int. Cl.[5] ..... E21B 17/10
[52] U.S. Cl. ..... 166/241.7
[58] Field of Search ..... 166/241.7, 241.6, 51, 166/60, 59, 241.5

[56] References Cited

U.S. PATENT DOCUMENTS

| | | | |
|---|---|---|---|
| 2,490,350 | 12/1949 | Grable | 166/241.7 |
| 2,656,890 | 10/1953 | Brandon | 166/241.6 |
| 3,343,608 | 9/1967 | Solum | 166/241.7 |
| 4,523,640 | 6/1985 | Wilson et al. | 166/64 |
| 4,543,998 | 10/1985 | Thomerson | 166/241.7 |
| 4,651,823 | 3/1987 | Spikes | 166/241.7 |
| 4,688,636 | 8/1987 | Hennessey | 166/241.7 |

*Primary Examiner*—Ramon S. Britts
*Assistant Examiner*—Frank S. Tsay
*Attorney, Agent, or Firm*—Guy McClung

[57] ABSTRACT

A centralizer for well casings is disclosed which, in one aspect has spring strips which are normally bowed to centralize the casing, but which are held in a collapsed disposition against the casing while the casing is positioned in a borehole. The holding force may be provided by a band and/or an arrangement of struts which are released when the casing is positioned. An additional energizing device may be provided to increase the bowing of the spring strips for more certain engagement with the surrounding borehole.

29 Claims, 18 Drawing Sheets

CENTRALIZERS FOR OIL WELL CASINGS

The invention relates to centralizers for oil well casings.

As an oil well is drilled, the casings are lowered from a derrick in a string into the borehole so formed and drilling mud is circulated down the casing string, through the end of the final casing, back up through the annular space between the casing string and the borehole. At intervals, the casing string is cemented in position by pumping a suitable cement into the casing string which passes out of the final casing and into the annulus between the casing string and the borehole, displacing the mud, and which, when set, holds the casing string in position.

It is important that all of the annular space between the casing string and the surrounding borehole is filled with cement and that the cement is firmly bonded to both the casing string and the borehole. In order to achieve this, it is important that all of the drilling mud is displaced from this space by the cement.

The mud is unlikely to be placed successfully if the casing string is not located centrally in the borehole.

If the casing string is close to, or touching, the borehole then pockets may be formed where mud collects and is not displaced by the cement.

Such centralization of the casing string is important where the borehole is vertical, but is even more important where the borehole is at an angle to the vertical, particularly where it is horizontal or nearly horizontal. This is because in such angled or horizontal boreholes gravity tends to drop the casing string on to the surrounding borehole.

It has been usual to centralize the casing string by the use of centralizers. These have customarily been of two forms. A first form has a number of bowed springs arranged around a casing and connected to sleeves which are mounted on the casing. The portions of the springs remote from the casing surface engage the surrounding borehole to centralize the casing but do not impede substantially the flow of cement and mud. A second form comprises a one-piece sleeve which fits over the casing and is provided with angularly-spaced, longitudinally-extending ribs which engage the surrounding borehole with the passages formed between the ribs allowing flow of cement and mud.

Though such centralizers have been used successfully for many years in vertical or near-vertical boreholes, they are less satisfactory when used in horizontal or near-horizontal boreholes. This is because to pass casing into such horizontal or near-horizontal boreholes requires the casing string to pass from a vertical section of the borehole to the horizontal or near-horizontal section around a corner and the projecting springs or ribs on the presently used centralizers can catch on such a corner and prevent or impede the passage of the casing.

For this reason, it has become customary to use few, if any, centralizers in horizontal or near-horizontal boreholes. This can produce the cementing problems described above and can also produce problems should explosive perforation of the casing be required in such a borehole.

U.S. Pat. No. 2,490,350 discloses a centralizer for oil well casing which centralizer comprises an annular mounting by which the centralizer may be mounted on an outer surface of a casing and a plurality of members carried by the mounting at spaced positions therearound, wherein the members are held by a control device in a collapsed disposition in which the members extend along said casing closely adjacent said outer surface of the casing, said control device being remotely operable so that the members move from said collapsed disposition to a deployed disposition in which the members extend away from said mounting for engagement with an associated borehole.

Thus, by holding the members in a collapsed disposition until the centralizer and the associated casing string has been deployed, the members do not impede the passage of the casing string into and through the borehole.

The disadvantage of this arrangement is that the control device passes through the wall of the casing thus creating a localised area of low bursting strength.

A similar problem arises in U.S. Pat. No. 4,523,640 where the bows of a well tool are inhibited from radial expansion by a collar which is secured to a tube by a meltable shear pin which extends through the collar into a bore tapped in the pipe.

In U.S. Pat. No. 2,656,890 springbows of a centralizer are held in a collapsed position by a collar which is pushed down the wellbore by the springbows. When the casing reaches the desired position it is raised. Prongs on the collars hopefully engage the wellbore so that the collars stationary whilst the centralizers rise, this relative movement releasing the springbows. Retention of the prongs by the wellbore is not reliable and consequently release of the springbows cannot be guaranteed therefore making this generally unsatisfactory.

The present invention is characterized in that the control device is disposable wholly radially outwardly or wholly radially inwardly of said casing and is remotely operable when said casing is in its desired position to deploy said members.

The following is a more detailed description of some embodiments of the invention, by way of example, reference being made to the accompanying drawings in which.

Figure 1:
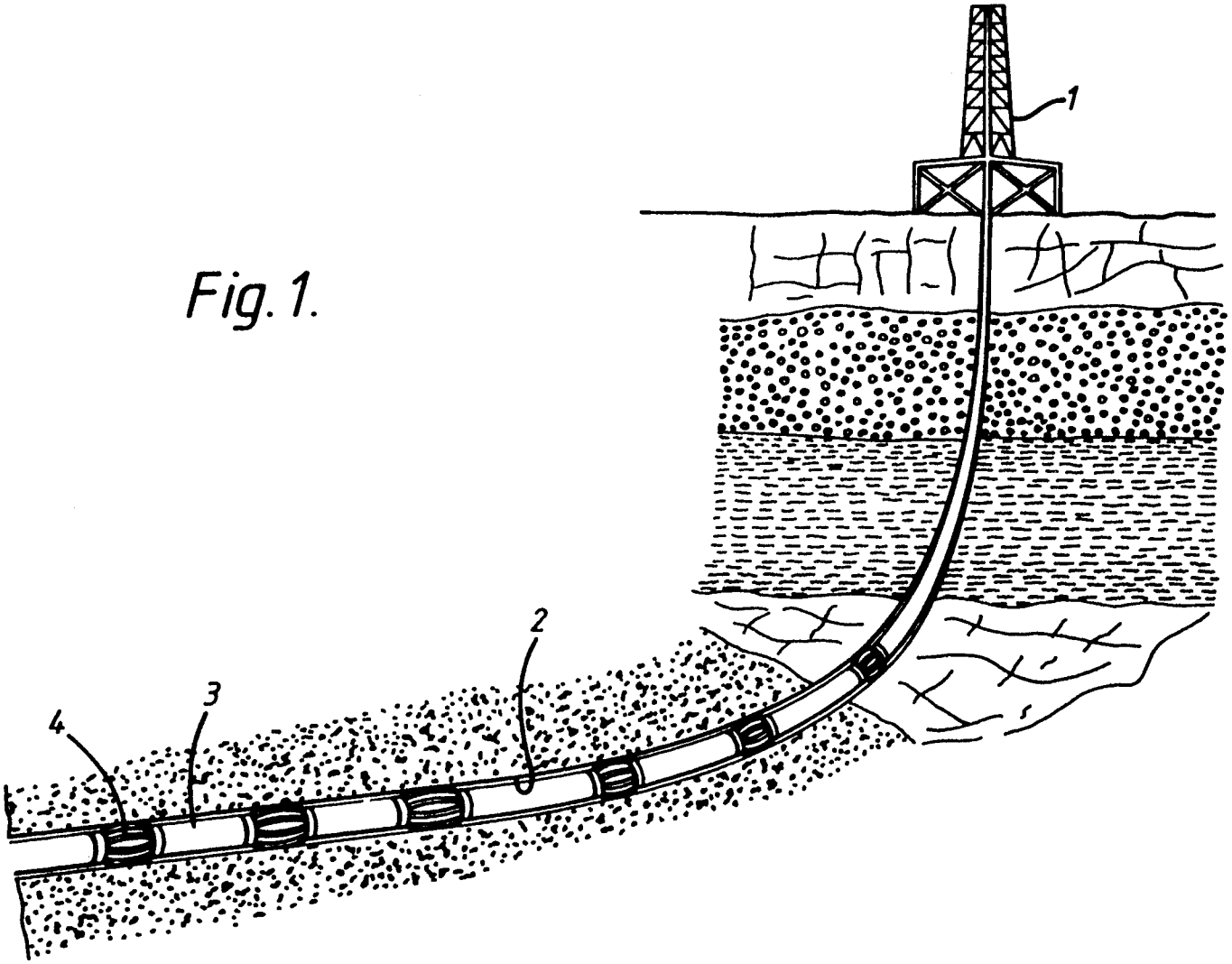
FIG. 1 is a schematic view of an oil well showing a casing string extending from a derrick to a deposit, with the casing string extending from the derrick in a vertical direction and then extending in an almost horizontal direction.
Figure 2:
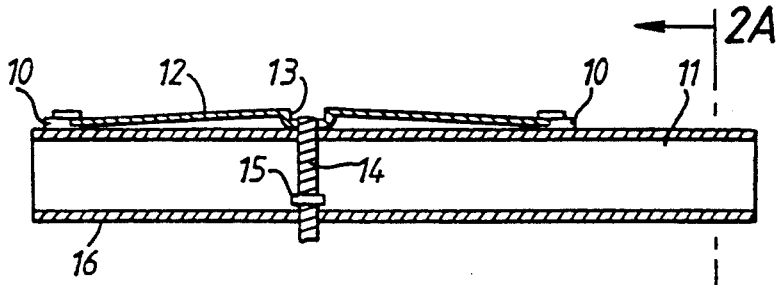
FIG. 2 is a side elevation, partly in section, and a cross-sectional end view, of a portion of a casing of an oil well showing a first form of centralizer in a collapsed disposition.
Figure 2A:
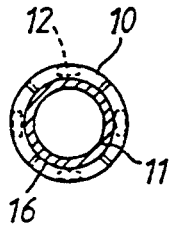
Figure 3:
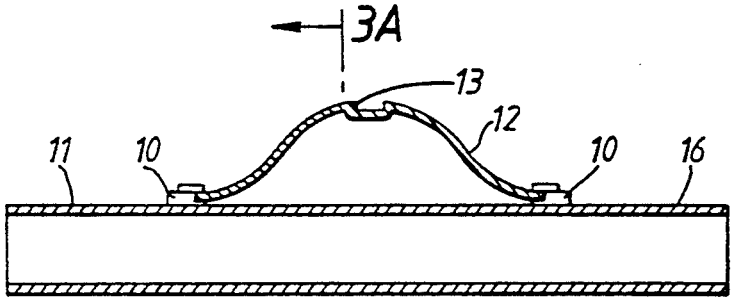
Figure 3A:
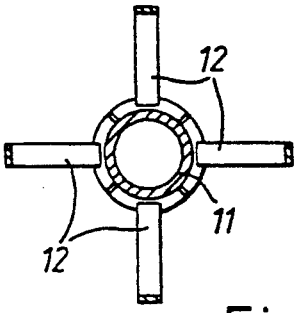
Figure 4:
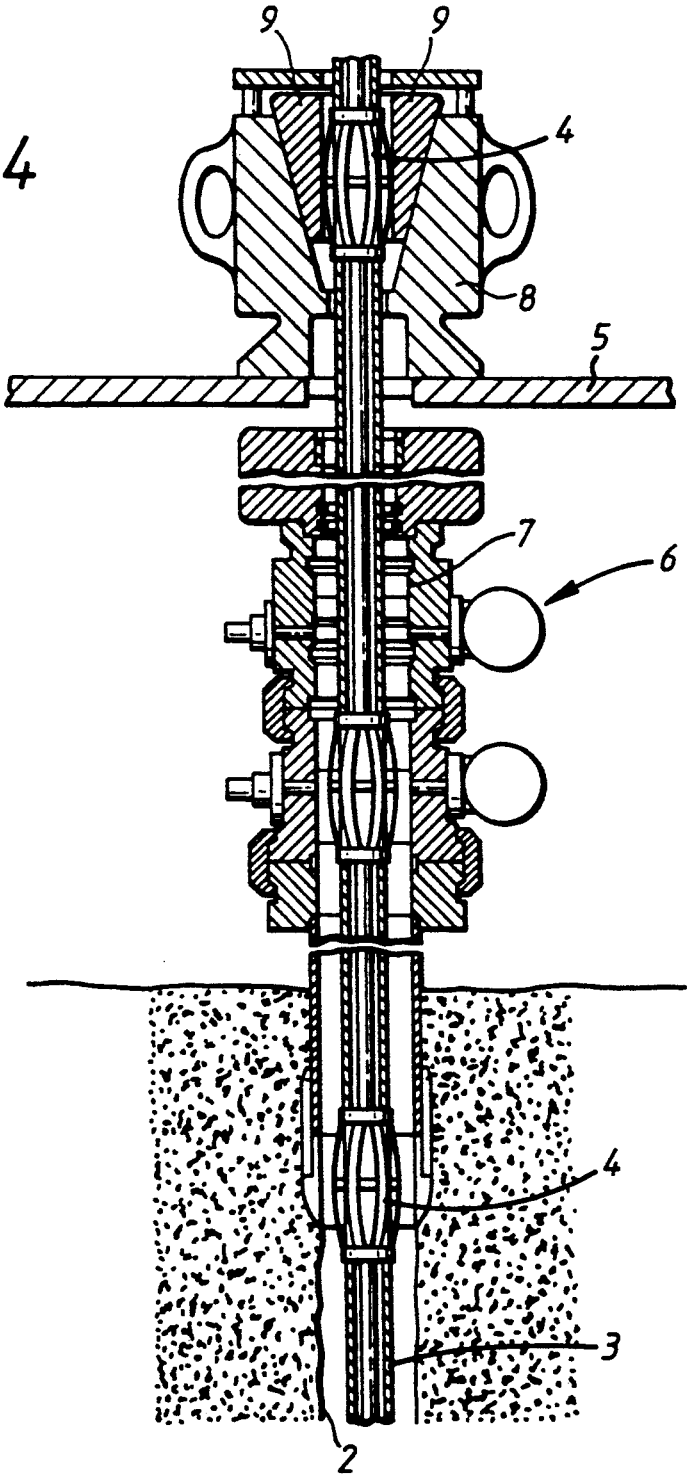
Figure 5:
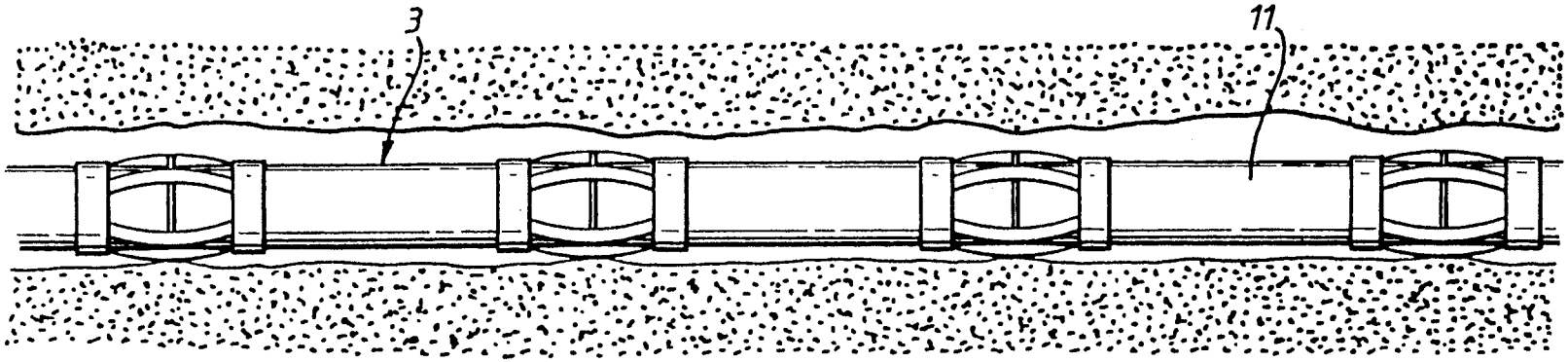
Figure 6:
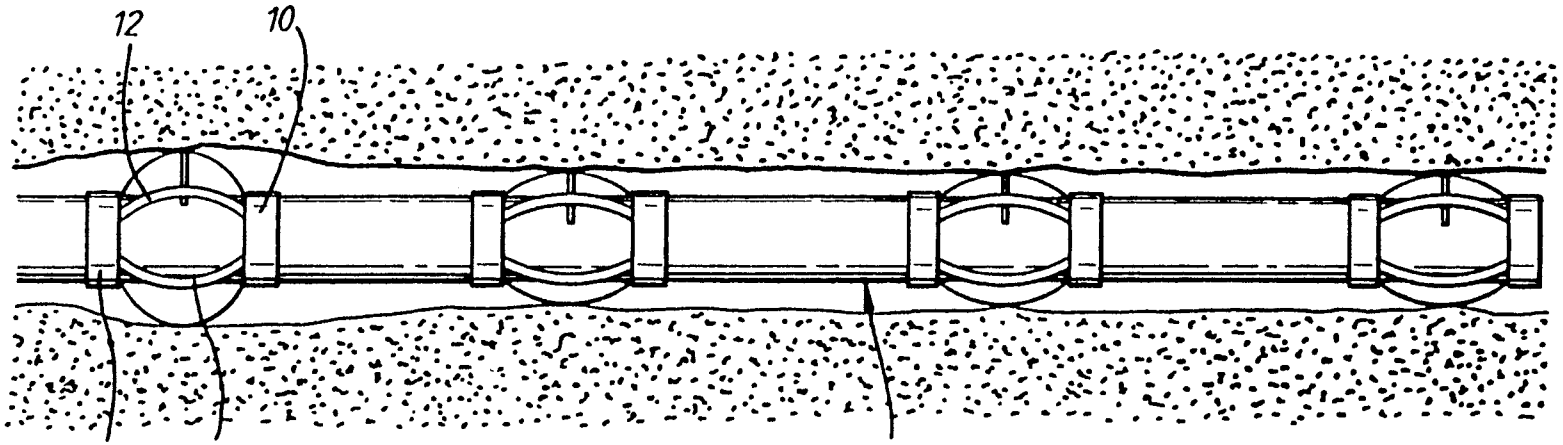
Figure 7:
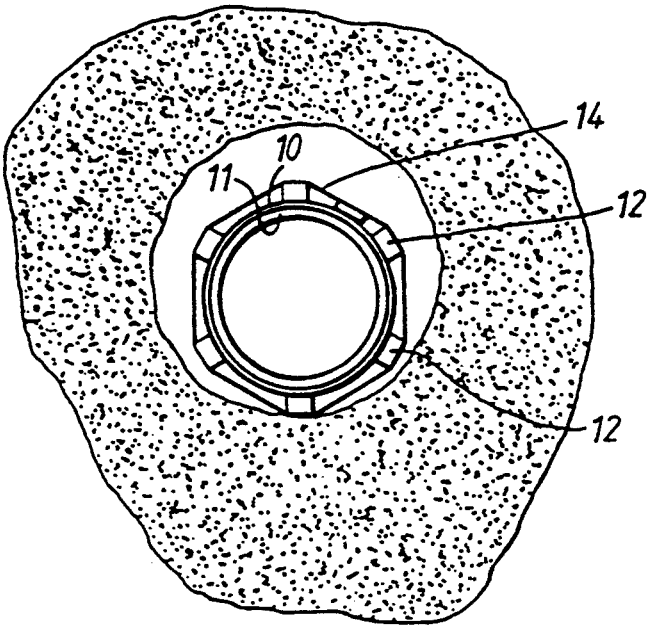
Figure 8:
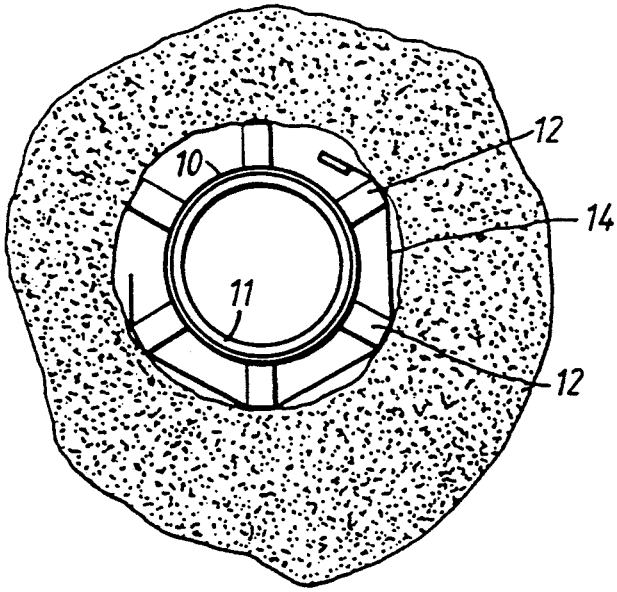
Figure 9:
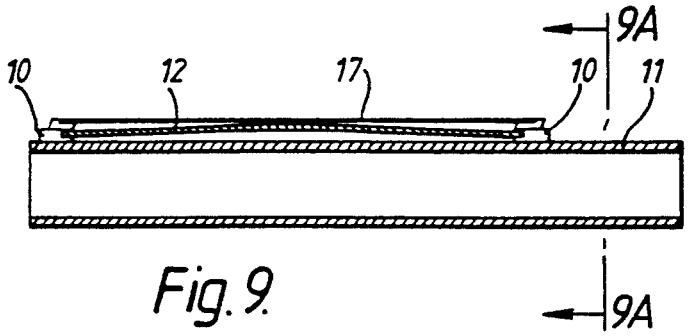
Figure 9A:
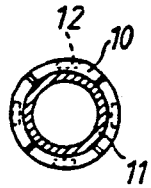
Figure 10:
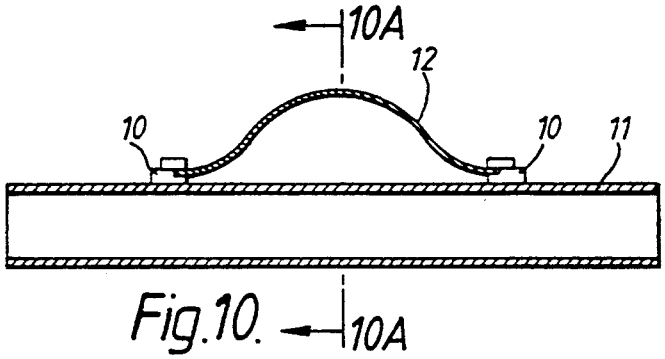
Figure 10A:
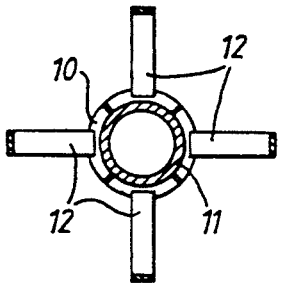
Figure 11:
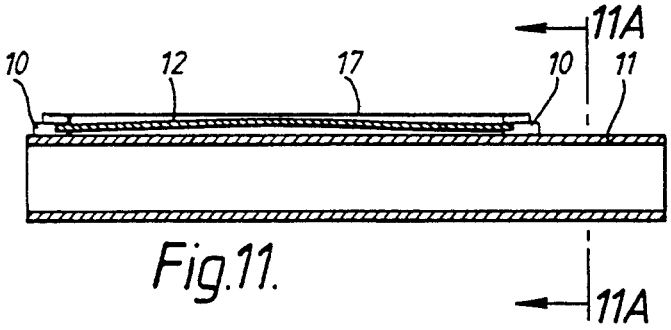
Figure 11A:
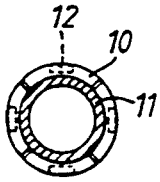
Figure 12B:
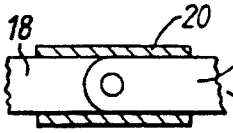
Figure 12:
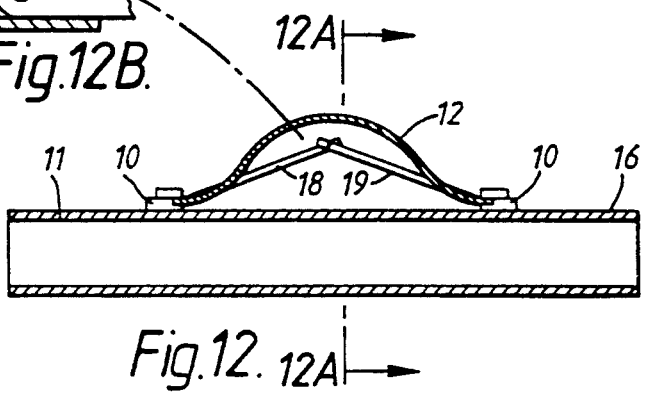
Figure 12A:
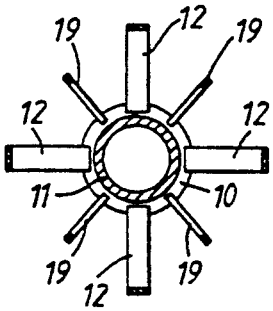

FIG. 3 is a similar view to FIG. 2, but showing the centralizer in a deployed position, FIG. 4 is a schematic cross-section of an upper end of the oil well of FIG. 1 showing a piping head below a working deck of the derrick and a housing above the working deck and showing a casing string carrying centralizers of the kind shown in FIGS. 2 and 3 passing into the bore via the housing and piping head, FIG. 5 shows the centralizer of FIGS. 2 and 3 on a casing within a borehole and in a collapsed disposition, and FIG. 6 is a similar view to FIG. 5 but with the centralizer deployed, FIG. 7 is a cross-sectional view of the centralizer of FIGS. 2 and 3 on a casing within a borehole and in a collapsed disposition, FIG. 8 is a cross-sectional view of the centralizer of FIGS. 2 and 3 on a casing with a borehole and in a deployed disposition, FIG. 9 is a similar view to FIGS. 2 and 3, but showing the second form of centralizer in a collapsed disposition, FIG. 10 is a similar view to FIG. 9 but showing a second form of centralizer in a deployed disposition, FIG. 11 is a similar view to FIGS. 2, 3, 9 and 10 but showing a third form of centralizer in a collapsed disposition in both cross-section and side elevation, FIG. 12 is a similar view to FIG. 11 but showing a third form of centralizer in a deployed disposition in both cross-section and side elevation and showing a detail of a holding sleeve positioning a pair of struts of the centralizer device.

Figure 13:
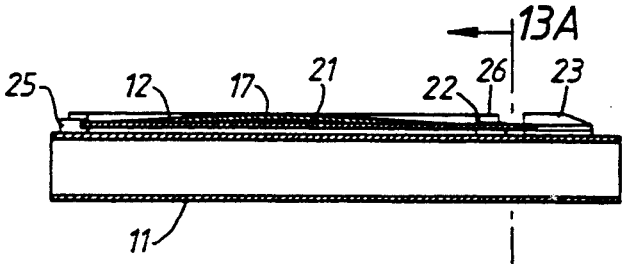
Figure 13A:
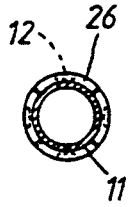
Figure 14:
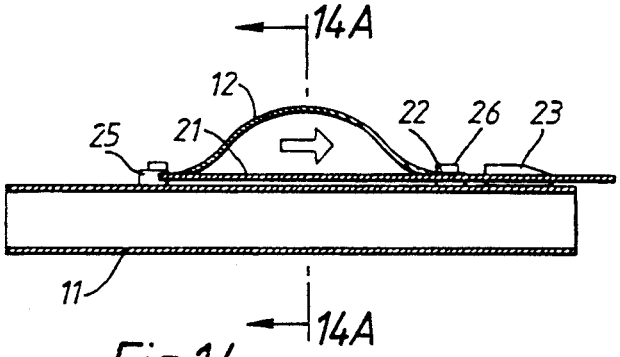
Figure 14A:
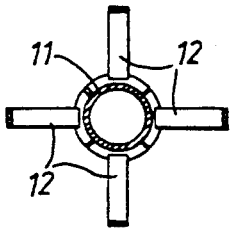
Figure 15:
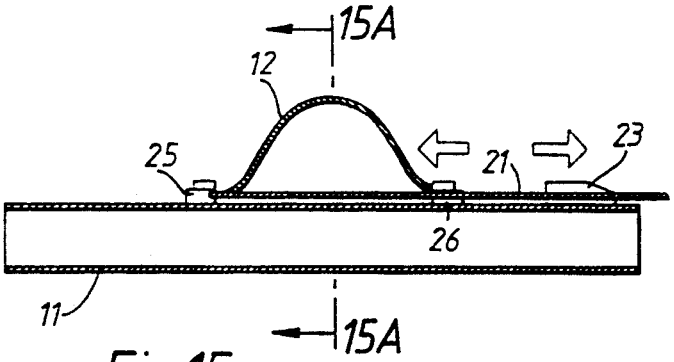
Figure 15A:
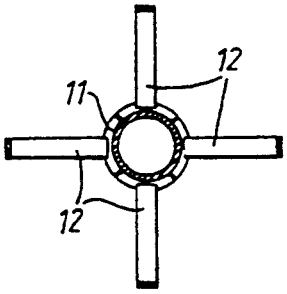
Figure 16:
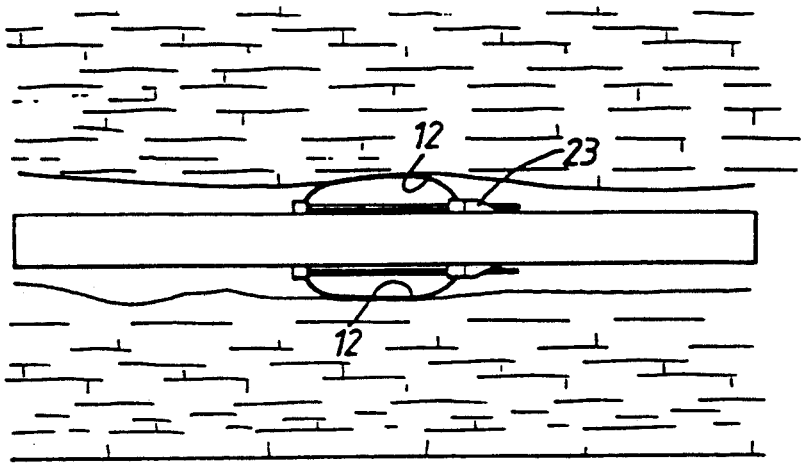
Figure 17:
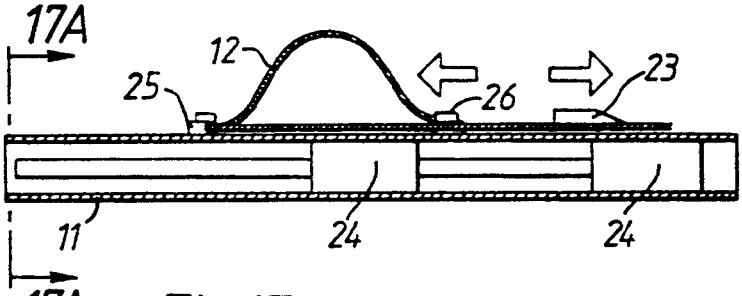
Figure 17A:
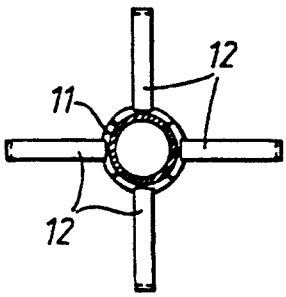
Figure 18:
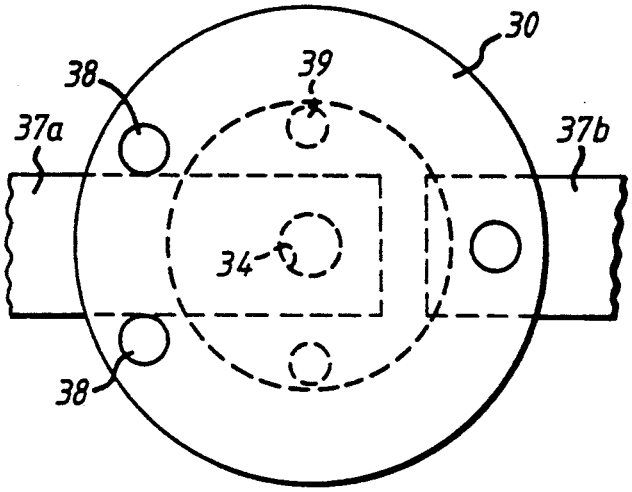
Figure 18A:
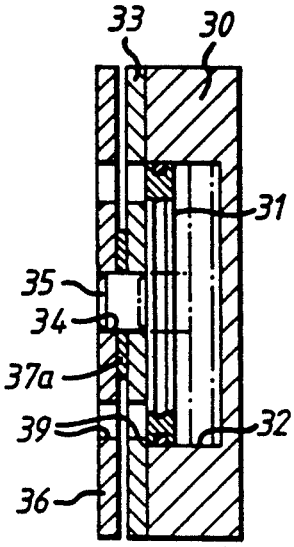
Figure 19:
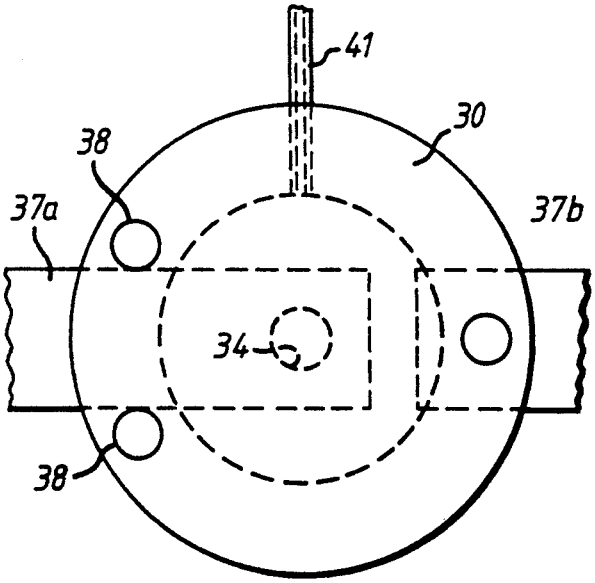
Figure 19A:
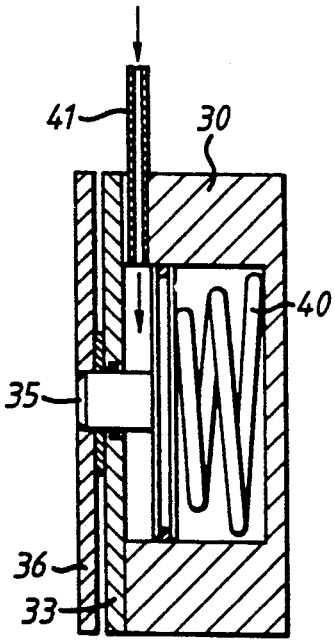
Figure 20:
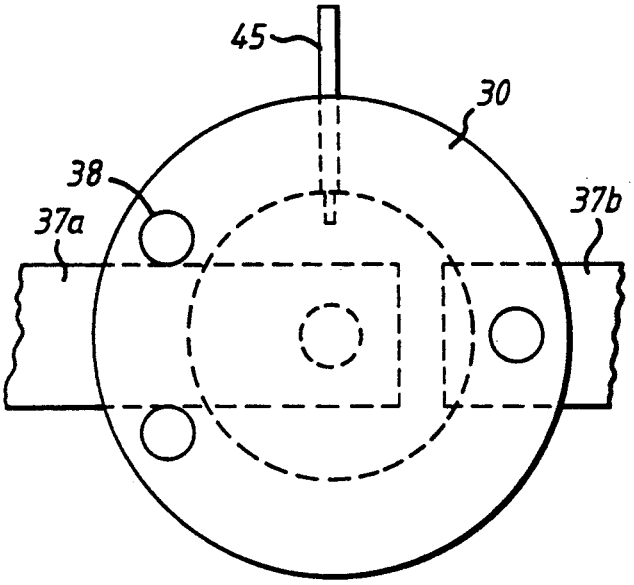
Figure 20A:
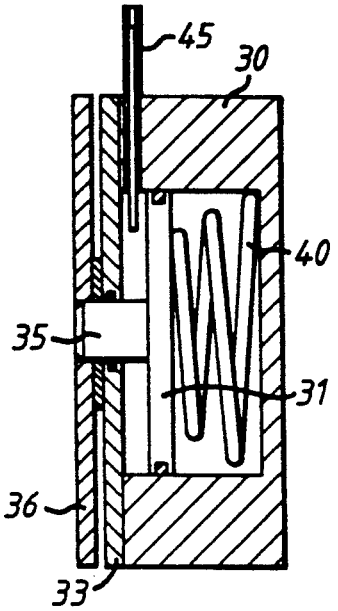
Figure 21:
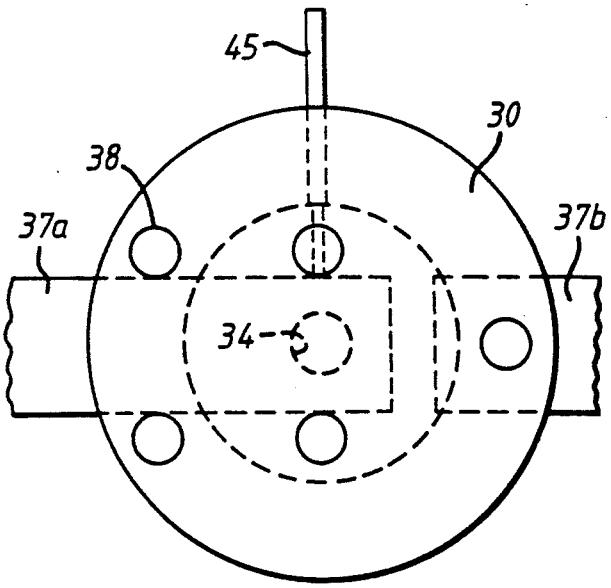
Figure 21A:
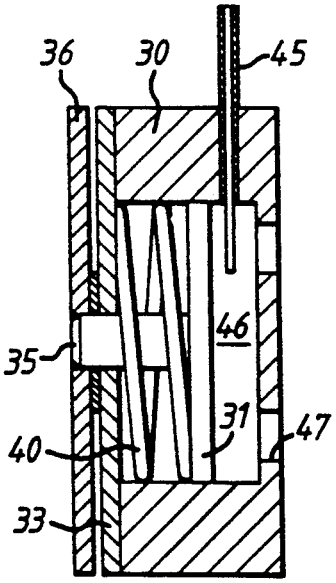
Figure 22:
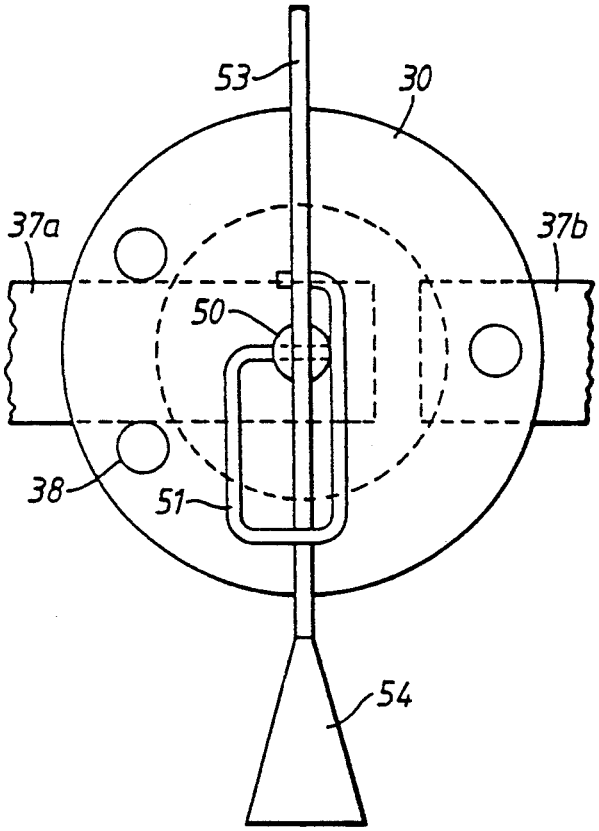
Figure 22A:
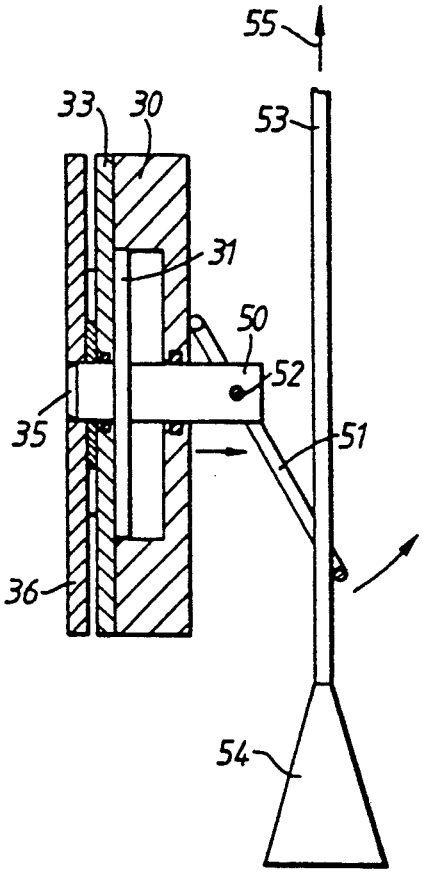
Figure 23:
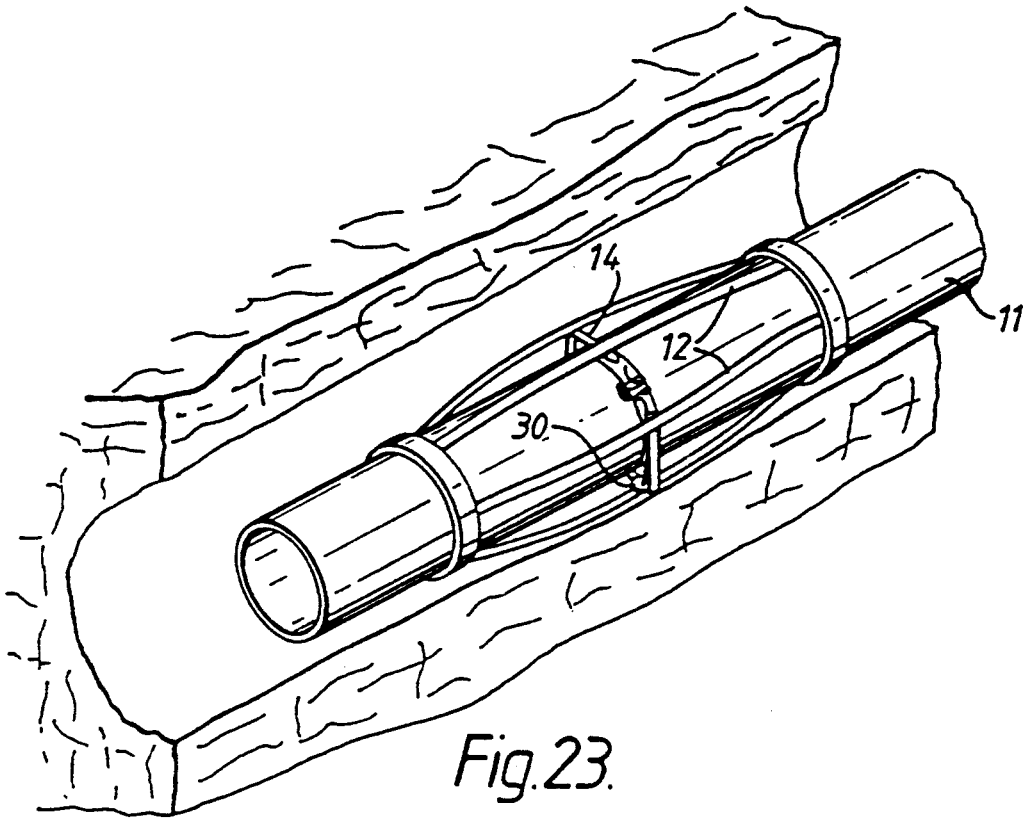
Figure 24:
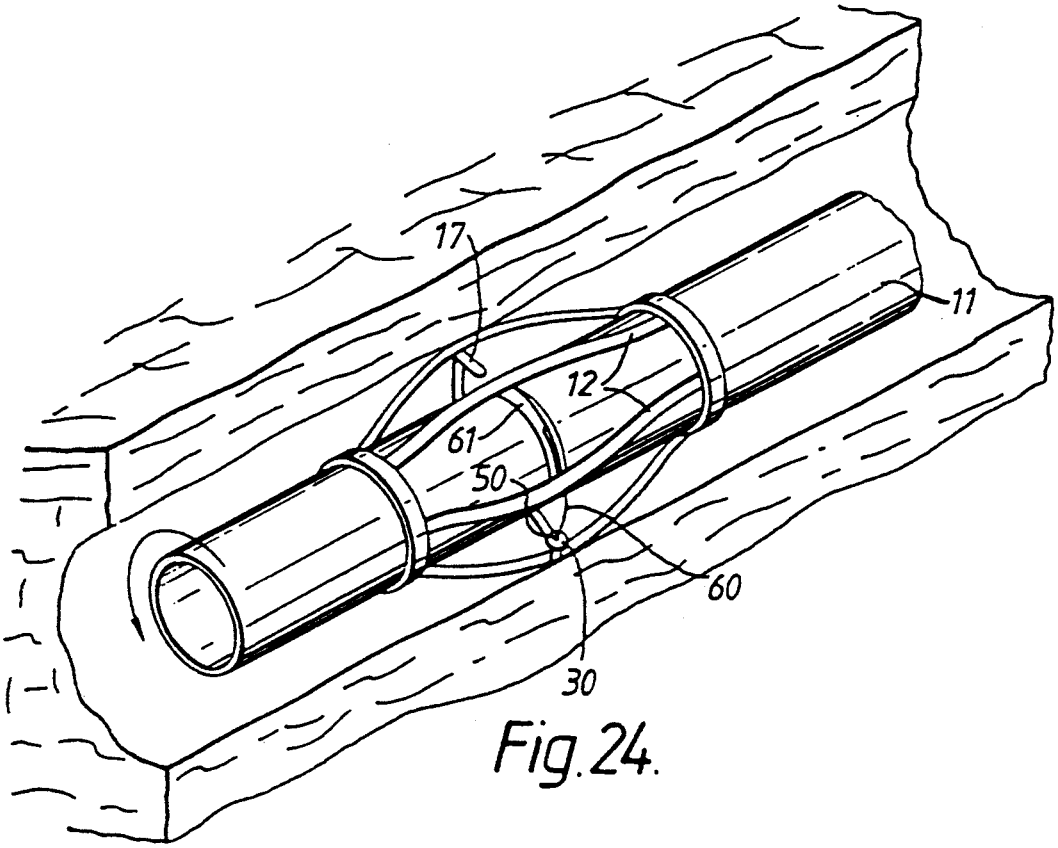
Figure 25:
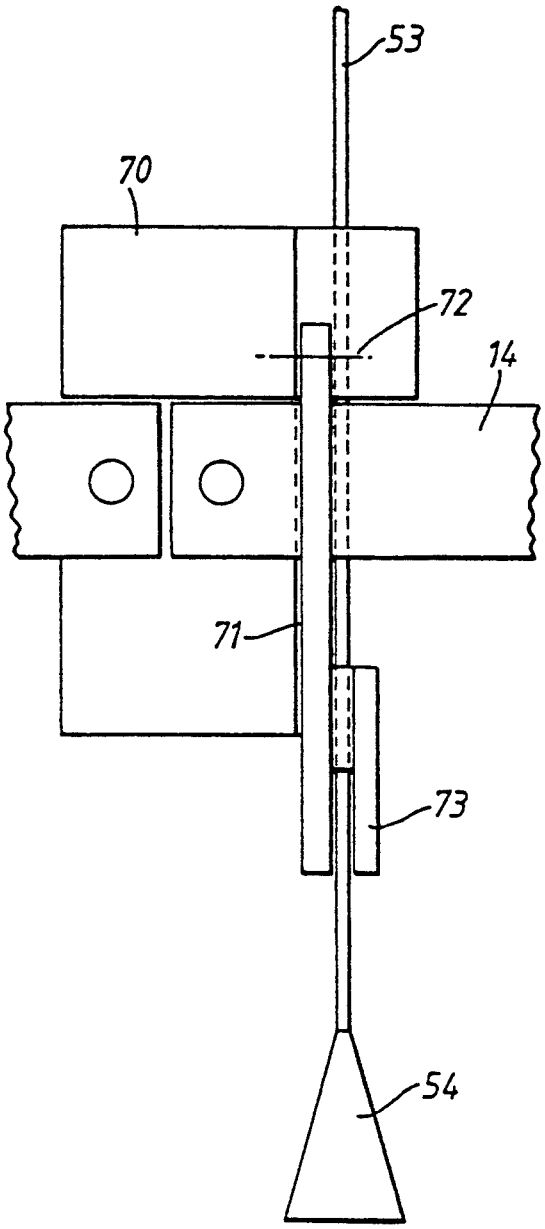
Figure 25A:
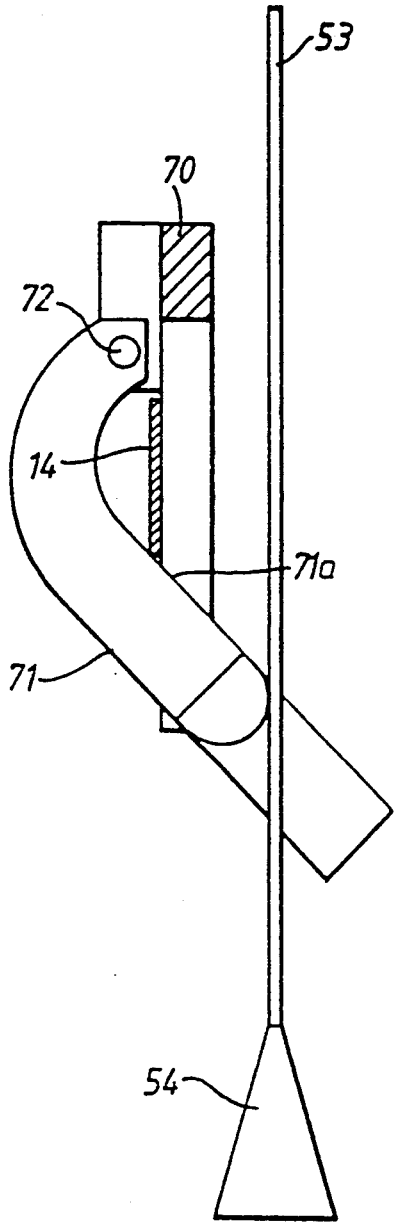
Figure 26:
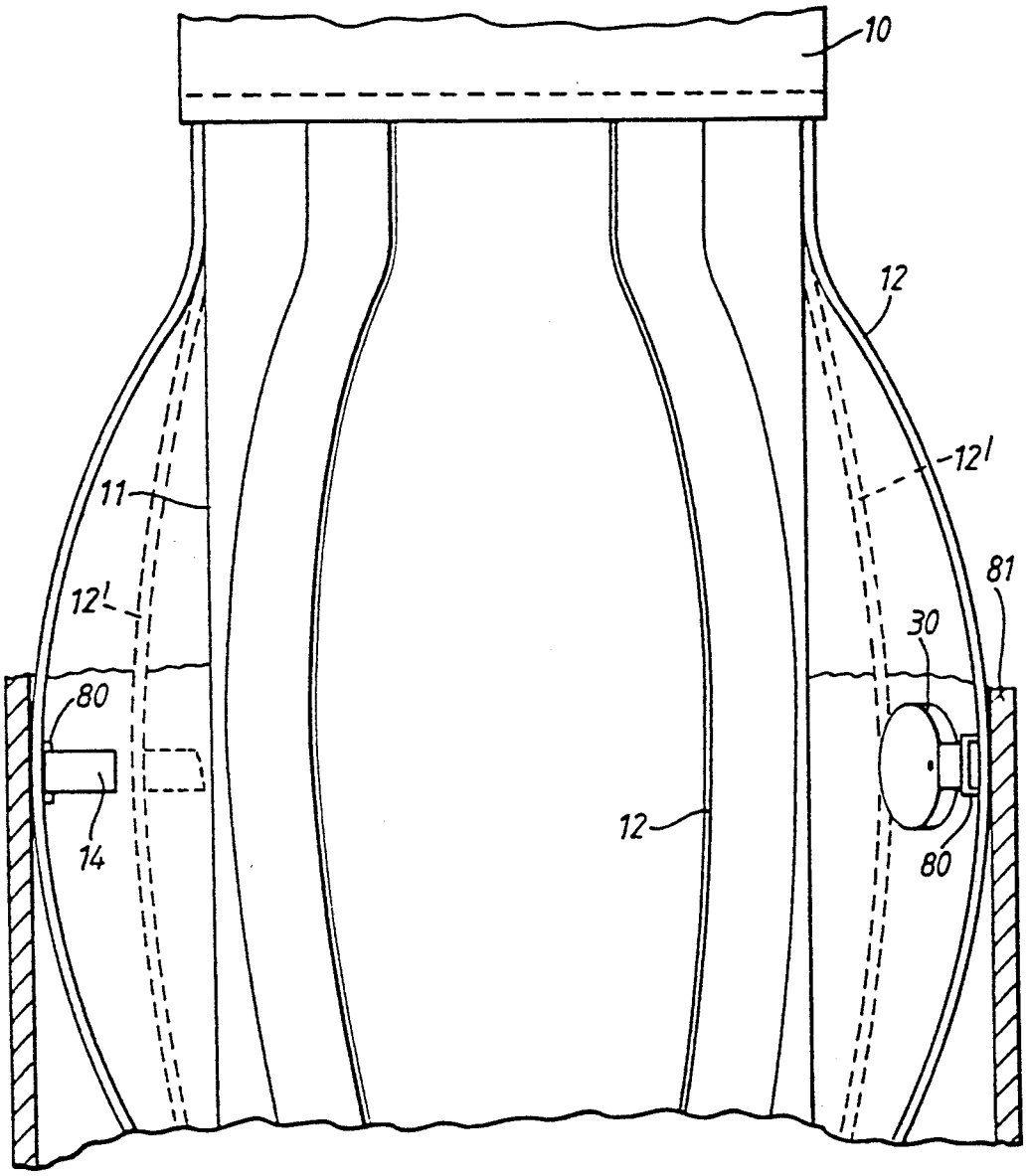
Figure 27:
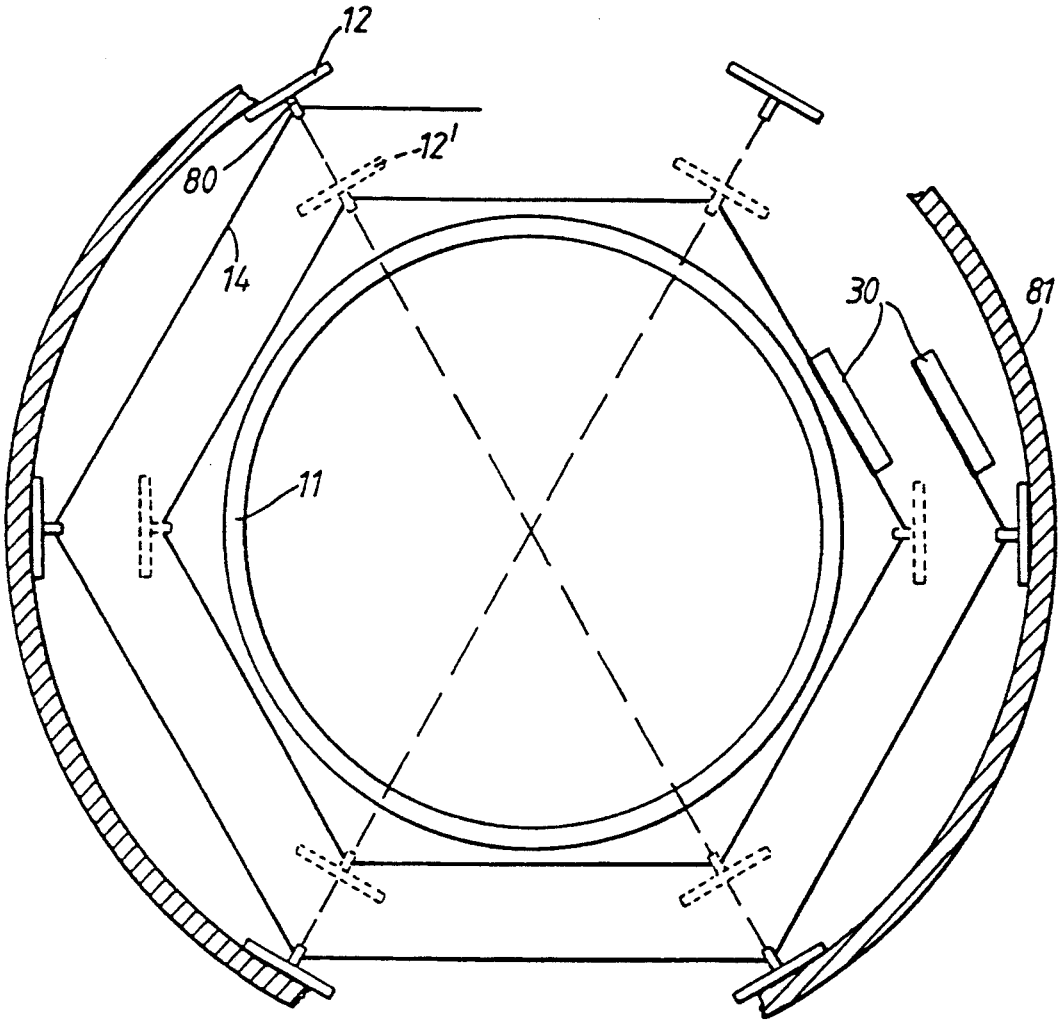
Figure 28:
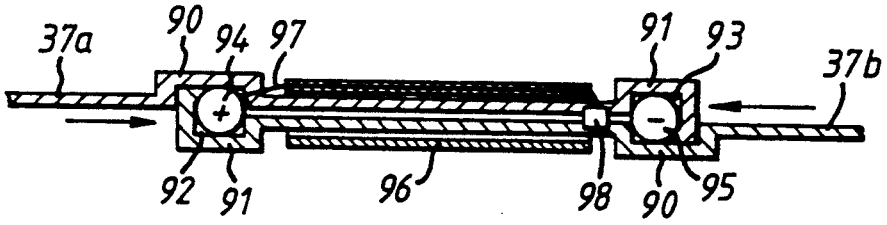
Figure 29:
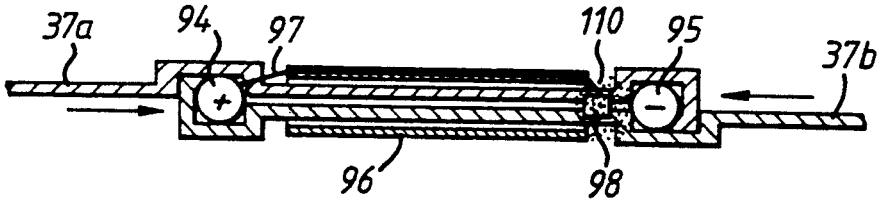
Figure 30:
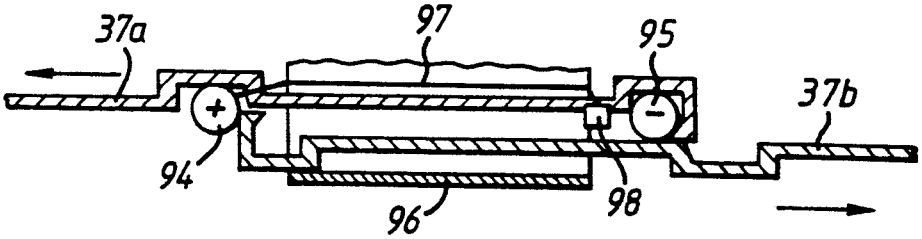
Figure 31:
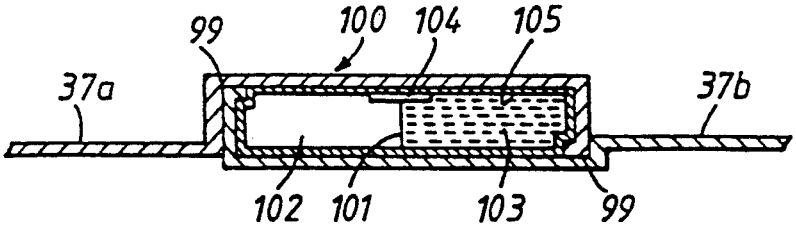
Figure 32:
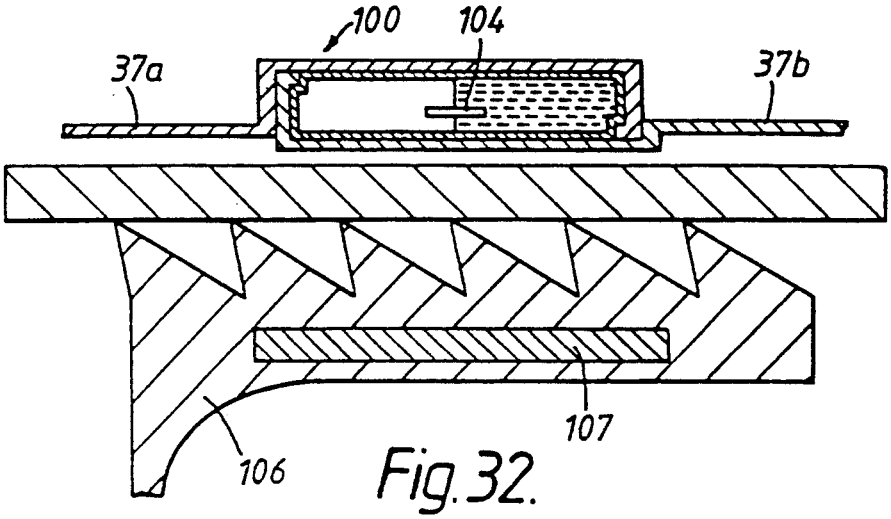
Figure 33:
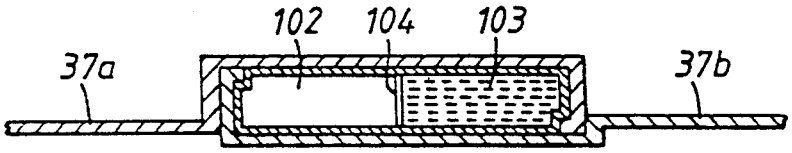
Figure 34:
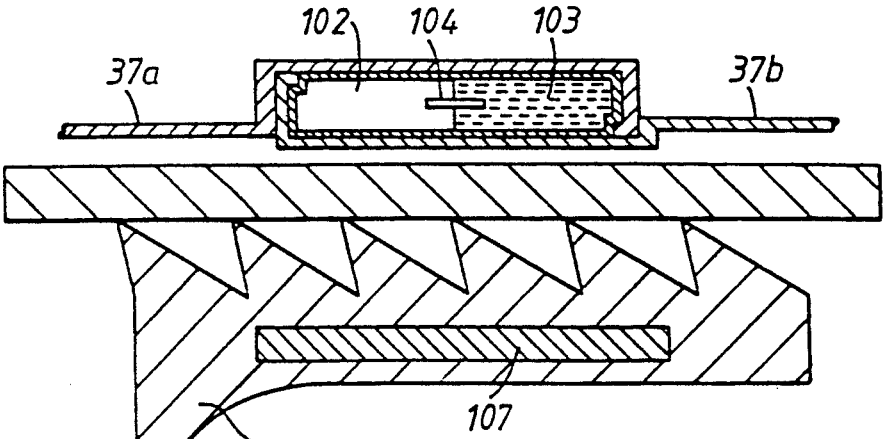
Figure 35:
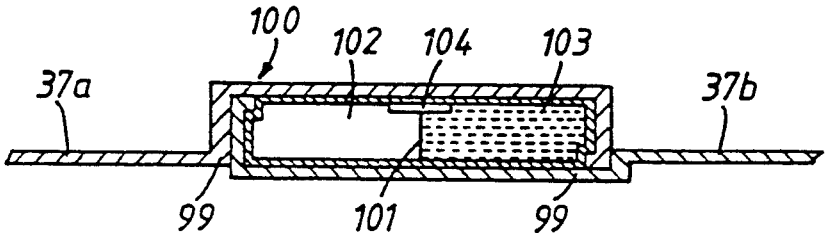
Figure 36:
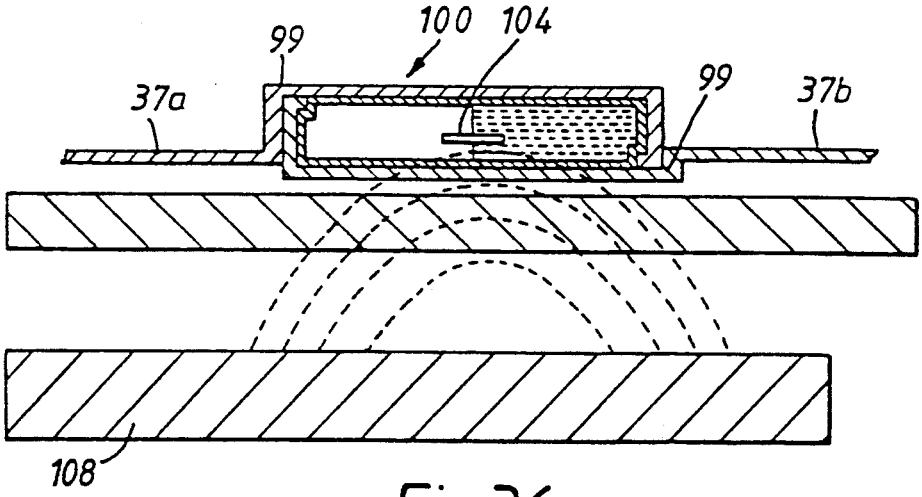

FIG. 13 is a similar view to FIGS. 9 and 10 but showing a fourth form of centralizer in a collapsed disposition in both cross-section and side elevation, FIG. 14 is a similar view to FIG. 13 but showing the fourth form of centralizer in a first deployed position ub both cross-section and side elevation, FIG. 15 is a similar view to FIGS. 9 and 10 but showing the fourth form of centralizer in a second deployed position in both cross-section and side elevation, FIG. 16 is a section through a horizontal borehole showing the fourth form of centralizer in the second deployed position of FIG. 15, FIG. 17 is a similar view to FIG. 15 but showing an alternative mode of energizing the fourth form of centralizer, FIG. 18 is a plan view and a cross-section of a locking device for holding and releasing a band of a centralizer of the kind shown in FIGS. 2 and 3, the locking device comprising a pressure element including an air cushion within the free cylinder space, FIG. 19 is a plan view and a cross-section of a pressure element similar to that shown in FIG. 18 comprising a piston prestressed by means of a mechanical spring and a duct which is in communication with the free piston space at a piston side facing away from the prestressing spring, FIG. 20 is a further embodiment of the pressure element of the kind shown in FIGS. 18 and 19 comprising a heating line which leads into a free space at a side of the piston facing towards a spring, FIG. 21 is a plan view and a cross-section of an alternative embodiment of a pressure element of the kind shown in FIGS. 18 to 20 in which a free space is filled with a material which is solid but fusible by means of heating resistances, FIG. 22 is a plan view and a cross-section of an additional form of pressure element of the kind shown in FIGS. 18 to 20 comprising a mechanical lever system for releasing a piston pin from an opening of an extremity on a band, FIG. 23 is a cross-sectional view of a borehole showing a system for releasing a locking device for a band which may be operated by rotation of the casing string, FIG. 24 shows the system according to FIG. 23 with a band released and and spring strips unstressed, FIG. 25 is a locking device in the form of a securing plate to which is fastened a cutting tool fastened for operation by a traction element, FIG. 26 is a cross-sectional view of a part of a casing string carrying a centralizer and partially inserted in a lining, FIG. 27 is a cross-section through the centralizer of FIG. 26, FIG. 28 is a schematic cross-sectional view of the ends of a band of a centralizer of the kind shown in FIGS. 2 and 3 showing a battery and fuse wire system for release of the band, FIG. 29 is a similar view to FIG. 28 but showing the release of the band, FIG. 30 is a similar view to FIGS. 28 and 29 showing the band released, FIG. 31 is a schematic cross-sectional view of the ends of a band of a centralizer of the kind shown in FIG. 2 and 3, showing magnetic actuation and chemical release of the band, FIG. 32 is a similar view to FIG. 31 showing the magnetic actuation, FIG. 33 is a schematic cross-sectional view of the ends of a band of a centralizer of the kind shown in FIGS. 2 and 3 showing a further mode of release by magnetic actuation and chemical release of the band, FIG. 34 is a similar view to FIG. 33 showing the release, FIG. 35 is a schematic cross-sectional view of the ends of a band of a centralizer of the kind shown in FIGS. 2 and 3 with wire line actuation and chemical release of the band, and FIG. 36 shows the release of the band.

The casing centralizers now to be described with reference to the drawings can be utilized in an oil well of the kind shown in FIG. 1. As shown in FIG. 1, oil bearing deposits are reached from a drilling derrick 1, and are not only located at great depths but also at a position horizontally spaced from the derrick location. The bore 2 as a whole consequently forms an arc merging from the vertical into the horizontal through the rock, and this bore 2 has to be followed by a casing string 3 comprising individual casings 11. The force with which the pipeline bears on the bore sides creates considerable frictional forces, especially in the case of a horizontal run, which may damage the casing string. For this reason, the casing string 3 is protected against contact with the rock by means of centralizers 4 of the kinds to be described below.

Referring first to FIGS. 2 and 3, the first form of centralizer comprises a pair of metal sleeves 10 whose interior diameter is substantially equal to the exterior diameter of a casing 11 of a casing string for an oil well borehole. A typical casing diameter may be 125 mm.

Four spring strips 12 are connected between the sleeves and spaced equi-angularly around the sleeves 10. Each spring strip has a bowed unstressed profile as shown in FIG. 3 and is provided intermediate its ends with a channel 13.

In use, the sleeves 10 are located on a casing 11 by spanning a joint between casings 11 between a stop collar (not shown) such that the sleeves can slide on the casing to a limited degree. A band 14 is placed around the spring strips 12 in the channels 13 and is tightened to draw the spring strips 12 against the outer surface of the casing 11, as seen in FIG. 2. This moves the sleeves 10 to a maximum spacing.

The band 14 is held tight by a titanium link 15.

The casings 11 is then inserted in the casing string 3 (FIG. 1) in an oil well bore 2. This is achieved in the following way both in the embodiment described above with reference to FIGS. 2 and 3, but also in the subsequently described embodiments.

Referring to FIG. 4, each bore 2 is provided at the open upper end, below a working deck 5 of the derrick, with a safety and control valve system 6 as an assurance against gas and oil eruptions. This so-called piping head 6 is provided with a through passage 7 with cross-sections which are substantially smaller than the cross-section of the bore 2 itself. Above the working deck 5 is situated a housing 8 incorporating catching wedges 9 for guiding the casing string 3 into the bore 2. In the housing 8 too, the passage cross-sections are small compared to the bore diameter in the rock.

The centralizer 4 described above with reference to FIGS. 2 and 3 of the drawings passes readily through the housing 8 and through the piping head 6, because the spring strips 12 are held closely adjacent the surface of the casing string 3. This overcomes a problem of previous centralizers, where the spring strips are unstressed, and these must be forced through the housing 8 and the piping head 6. The casing string 3 is moved to a required position in the bore 2.

The circulation of mud is then halted and hydrofluoric acid is passed through the casing and into the annulus between the casing and the borehole. The titanium of the link 15 reacts with the hydrofluoric acid and softens to an extent that the ends of the bands separate under the spring biasing force of the spring strips 12 to release the band. The spring strips thus bow to their unstressed position shown in FIG. 3 and the sleeves 10 approach each other by sliding along the outer surface 16 of the casing 11.

Thus, as seen in the cross-sectional view of FIG. 3, four bowed string strips 12 project from the outer surface of the casing 11. As will be seen in FIGS. 6 and 8 these spring strips 12 hold the casing 11 central in the borehole.

Since the centralizer described above with reference to the drawings is held in the collapsed disposition until the associated casing is positioned in the borehole, there is no possibility of the centralizer snagging and preventing movement of the casing 11. The amount of bowing can be greater than with conventional centralizers, whose bowing is limited in order to reduce the possibility of snagging. The titanium link 15 is very secure during movement of the casing but parts very reliably on contact with hydrofluoric acid.

Referring next to FIGS. 9 and 10, a second form of centralizer 4 will now be described. Parts of the first and second forms of centralizer are common and thus bear the same reference numerals and will not be described in detail.

In the second centralizer, the narrow band 14 is replaced by a band 17 which overlies the whole of the centralizer. This wider band could be of a fabric or a plastics material. In comparison with the narrow band 14 of FIG. 1, it has the advantage that it can hold a greater spring force from the spring strips 12 and also can hold the spring strips 12 in a lower profile.

The band 17 may be rectangular and be formed into a casing holding the spring strips 12 by a titanium wire stitched along the matching edges of the band 17. The wire is then reacted with hydrofluoric acid, as described above, when the casing 11 is positioned in a borehole as described above. This will allow the spring strips 12 to move to the deployed position shown in FIGS. 6 and 8 for engagement with the borehole, as described above.

It will be appreciated that, in either of the embodiments described above, the band 14,17, need not be held by the use of titanium or released by the use of hydrofluoric acid. The band 14,17, could be held by some other material which can be reacted with a particular chemical to weaken the material and release the band when required. Alternatively, the band 14,17, could be held by some device which releases the band after a specified time or delay or by a device which is actuated to release the band 14,17, by electrical or magnetic means. Some embodiments of such devices will be described below.

Referring next to FIGS. 11 and 12, the third form of centralizer has parts common to the second form shown in FIGS. 9 and 10. Accordingly, those parts will not be described in detail and will be given the same reference numerals.

In the third form of centralizer, four pairs of struts 18, 19 are included, equally angularly spaced around the sleeves 10 intermediate the spring strips 12. The two struts 18,19 of each pair lie in a plane including the axis of the sleeves 10 and are pivotally connected together intermediate the sleeves 10. The ends opposite the pivotally connected ends, are themselves pivotally connected to an associated sleeve 10.

In a collapsed disposition, the struts 18,19 of each pair are aligned to one another close to an outer surface 16 of the casing 11. This causes the sleeves 10 to be moved to a maximum spacing which tends to hold the spring strips 12 in their collapsed disposition. In this position, as seen in the detail in FIG. 12, a titanium sleeve 20 is slid over the pivotally connected ends of each pair of struts 18,19 to hold the struts in this disposition.

When the band 17 is released by passing hydrofluoric acid around the centralizer, the hydrofluoric acid also weakens the sleeve 20. This allows the struts 19,20 to pivot relative to each other and permits the spacing of the sleeves 10 to be decreased. This arrangement has the advantage that the struts 18,19 allow stronger spring strips 12 to be used than in the embodiments of FIGS. 2, 3, 10 and 11. They provide an additional force to keep the sleeves 10 at their maximum spacing. In addition, when the spring strips 12 are deployed, the struts can engage the surrounding borehole and provide an additional centralizing force. This is best seen in the cross-sectional view in FIG. 12.

It will be appreciated, of course, that in this third form the sleeve may be omitted and the struts used alone to control the spring strips 12.

Referring next to FIGS. 13, 14 and 15, the fourth form of centralizer 4 shown in those figures has features common to the second embodiment, of FIGS. 9 and 10. Those features will not be described in detail and will be given the same reference numerals.

In the fourth form of centralizer 4, four struts 21 are provided spaced equi-angularly around the sleeves intermediate the spring strips. Each strut 21 has one end fixed to a sleeve 25 which is not connected to the casing 11 and extends parallel to the axis of the sleeves 25 and through apertures 22 in a sleeve 26 which is fixed to the casing. An end of each strut 21 projecting beyond the fixed sleeve 26 is received in an energizing device 23.

In use, the band 17 is released as described above. The spring strips then move to a first deployed position which is shown in FIG. 14. This results in the strip engaging in the energizing device, as seen in FIG. 14.

The energizing device 23 is then actuated to move along the casing 11 as shown in FIG. 15 in a direction away from the fixed sleeve 26. This draws the movable sleeve 25 closer to the fixed sleeve 26 and so increases the bowing of the spring strips 12.

The strut 21 and the fixed sleeve 26 may include a ratchet arrangement which prevents return movement of the strut 21.

This additional bowing movement of the spring strips 12 allows the strips to engage more firmly with the borehole, as shown in FIG. 16. This allows the centralizer 4 to accommodate irregularities or portions of the borehole which have widened due to formation collapse or wash out.

The energizing device 23 may be actuated in any convenient way. One such way is shown in FIG. 17. In this arrangement, the energizing device 23 is in communication with the interior of casing 11. A liquid under high pressure is passed through coiled tubing between two plugs 24. At an energizer, the plugs 24 are deployed to define a closed chamber in that section of the casing which communicates with the device 23. The chamber pressure is then increased with high pressure liquid from the coil and this liquid acuates the energizing device 23.

Alternatively, the whole casing could be pressurized.

It will also be appreciated that the energizing device 23 may be operated by provision of projecting fins or similar members which are arranged in the annulus between the casing 11 and the borehole and which act to move the energizing device when the pressure of material in the annulus is increased.

Although the centralizers described above with reference to the drawings have four spring strips, it will be appreciated that they may be provided with more or less spring strips. In addition, although all the forms of centralizer have spring strips extending between two sleeves, the embodiments of FIGS. 2, 3, 9 and 10 in particular, may include only one sleeve. In this case, the spring strips may, in their deployed disposition, simply extend at an angle away from the casing surface 16.

As suggested above, the band 14 of the embodiment of FIGS. 2 and 3 need not be released using an acid, as described above with reference to those Figures. There will now be described some alternative ways of releasing the band 14, parts common to FIGS. 2 and 3, and to the Figures now to be described having the same reference numerals and not being described in detail.

Referring first to FIG. 18, a locking device is provided to control release of the band 14, in the form of a pressure element 30 comprising a piston 31, which is displaceably mounted in the cylindrical bore of the pressure element. The cylindrical bore is closed by means of a cover 33 which has a central opening 34 through which extends a pin 35 of the piston 31. A second cover 36, which may for example be secured via spacer screws, is placed at a distance from the cover 13.

Two extremities 37*a* and 37*b* of the band 14 engage in the gap between the covers. One extremity, 37*a*, is provided with an opening which is aligned with the central openings of the covers 33 and 36. The piston pin 35 extends through the opening as shown. The band extremity 37*b* is immovably joined to the cover 33. The releasable extremity 37*a* is located between two guide pins 38 extending between the covers 33 and 36. Openings 39 in the covers 33 and 36 provide communication between one piston side and the ambient pressure.

In use, the piston side facing away from the piston pin 35 is acted upon by the pressure of the gas present in the free cylinder space, for example air. The gas column forms a gas spring whose force is overcome when the ambient pressure exceeds a limiting value. The piston 31 is then pushed back under appropriate compression of the gas volume within the free cylinder space. In doing so, it draws the pin 35 out of the central openings and releases the extremity 37*a* of the band 14. The spring strips 12 of the centralizer 4 are then free to expand into contact with the surface surrounding the pipe, e.g. the rock.

In a second form of the locking device shown in FIG. 19, the pressure element 30 is provided with a mechanical spring 40 instead of an air cushion. The side of the piston 31 which faces away from the spring may be acted upon by pressure via a duct 41. In this case the covers 33 and 36 lack the openings for communication with the ambient atmosphere. This kind of locking device operates in the same way as the embodiment according to FIG. 18.

A third form of locking device is shown in FIG. 20 and largely resembles that of FIG. 19. The force of the mechanical spring 40 is controlled by means of a controllable gas pressure of a working fluid charge, for example a gas or liquid, present in a free space between one piston side of the element cover 33. The charge is heated by means of an electrical resistance, which is not illustrated, within the free space. The electrical power is supplied via a feed conductor 45. As the temperature rises, the gas in the free space expands or the liquid is initially converted into a gaseous state, both of which provide a large increase in volume and lead to the piston 31 being thrust back against the force of the mechanical spring 40. The piston 31 again withdraws the pin 35 from the releasable extremity 37*a* of the band 14 and so releases the band 14.

A variation of the embodiment of FIG. 20 is shown in FIG. 21 in which the mechanical spring 40 is situated at the piston side facing towards the element cover 33. The free space 46 present in the rearwardly situated section is filled with a fusible substance which may be placed in a fluid condition by means of a heating resistance supplied via the electrical lead 45. The material, when made fluid, may leave the cylinder space of the element 30 via draining orifices 47. The force of the spring assures a displacement of the piston 11, so drawing the pin 45 out of the opening of the band 14.

In an alternative form of release of the band 14, the melting or dissolution of the fusible substance may be induced by the supply of thermal energy by geothermal heat, which increases with the depth. It may equally be envisaged to feed in a solvent via a duct, so that the material present in the solid state in the free cylinder space may be dissolved by a chemical action. This also includes the possibility of dissolving the material during the bore flushing operation. A combination of several possibilities may also be contemplated to ensure release.

In a further alternative version of the locking device of FIGS. 18 to 21, shown in FIG. 22, the force of the piston 31 which is generated by means of a gas pressure within the free cylinder space, is cancelled by means of a mechanical lever system situated outside the pressure element. To this end, the piston is provided with a piston rod 50 extending outwards through the cylinder base. A lever 51 is pivotally connected to the piston rod 50. A power arm of the lever 51 is looped to embrace an end of a traction element 53 having a widened terminal part in the form of a cone 54. The other arm of the lever 51 is supported on the outer side of the pressure element 30. By a pull on the element 53 in the direction of the arrow 55, the cone 54 is drawn into contact with the looped arm section of the lever 51 and thus transfers its tractive force to the lever 51. The lever 51 pivots and draws the piston pin 35 out of the opening of the stressing element extremity 37*a* so releasing the band.

FIGS. 23 and 24 show a possible variation of the embodiment of FIG. 22 in which a traction element 60, for example a cable, has one end fastened to the piston rod 50 projecting out of the pressure element. The other end of the traction cable 60 is solidly joined to a ring 61 which fits immovably on the casing 11. The traction cable 60 is tensioned by rotation of the whole casing string to withdraw the piston pin 35 from the opening of the stressing element extremity 37*a*. The pressure element then resembles the embodiment according to FIG. 22, the free space being occupied either by an air cushion acting as a piston spring, or else by a mechanical spring.

Another possible structure of the locking device is shown in FIG. 25 in which both extremities of the band 4 are fixedly attached to a holding plate 70. A lever 71 is pivotally journalled on the holding plate 70 by means of a pivot pin 72. The lever 71 is constructed as a cutting tool appropriate for severing the band 4. A free end of the lever 71 carries a guiding element 73 for a traction cable 53 provided with a conical locking element 34 at its lower extremity. In use, the cone is drawn against the guiding element 54 when the cable 73 is pulled and transfers the tractive force to the lever 71, so that a cutting edge 71*a* of the cutting tool 71 severs the band 14 and releases the spring strips 12.

FIGS. 26 and 27 show an alternative way of holding the spring strips 12 in a collapsed disposition using a band 14. In this arrangement the centralizer 4 comprises sleeves 10, spring strips 12 extending between the sleeves 10 and a band 14. The spring strips 12 are indicated in the stressed state by a broken line and marked 12. Loops or eyes 80 are welded to the inward sides of the spring strips 12 and a straplike or cablelike band 4 is threaded through these loops or eyes 80. Since the eyes 80 are situated on the inward sides of the spring strips 12, their outer sides are not altered, so that no difficulties can be caused by sharp edges or corners. In the example depicted, the centralizer 4 mounted on the casing 11 is drawn into an outer pipe, for example a lining pipe 81, and is placed in contact with its inward side by releasing the band 4 by operation of a locking device of any of the kinds described above with reference to the drawings. The casing 11 may thereby be held centrally in a conventional manner.

Referring now to FIGS. 28 to 30, these illustrate an alternative means of releasing the extremities 37*a*, 37*b* of a band 14 of the kind described above with reference to FIGS. 2 and 3. In this case, each band extremity 37*a*, 37*b* is formed with two moulded parts 90,91 which together form two spaced chambers 92,93. One chamber 92 contains the positive half 94 of a battery. The other chamber 93 contains the negative half 95 of a battery.

The extremities 37*a*, 37*b* of the bands 14 are held together by a wrap of material 96 of a thermoplastic or other heat-sensitive material. An electrically conductive wire 97 is connected at one end to the positive battery half 94 and passes through the wrap 96 to terminate at a magnet 98 located adjacent the negative battery half 95.

In operation, the centralizer 4 is moved into a desired position as described above with reference to the drawings and an oil based mud containing iron filings is circulated through the casing string 3 and around the space between the casing string 3 and the borehole. As seen in FIG. 29, the iron filings are attracted by the magnet 98 and form a conductive path 110 between the magnet and the negative half 95 of the battery. This completes the circuit and causes the conductive wire 97 to heat up in turn causing the wrap 97 to split.

Thus, as seen in FIG. 30, the two band extremities 37*a*, 37*b* separate allowing the spring strips 12 to move to the deployed position.

A further mode of separating the band extremities 37*a*,37*b* is shown in FIGS. 31 and 32. In this case, each band extremity is formed with a shaped part 99 with the two shaped parts 99 together cooperating to form a closed chamber 100. A membrane 101 divides the chamber 100 into two parts and each part contains a different chemical 102,103. The two chemicals are chosen such that, when they are mixed together, their volume increases rapidly.

The membrane 101 holds a magnet 104 adjacent the radially outermost inner surface 105 of the chamber 100; the radial direction being measured relative to the axis of the casing 11 carrying the centralizer 4.

In use, a plug 106 is passed through the casing 11, as shown in FIG. 32. The plug 106 carries a magnet 107 which, as it passes the closed chamber 100, attracts the chamber magnet 104. This breaks the membrane 101 so causing the two chemicals 102,103 to mix. This results in an increase in volume which separates the shaped parts 99 so releasing the band 14. The spring strips 12 thus move to the deployed position.

Referring next to FIGS. 33 and 34, the arrangement shown in these Figures is similar to that shown in FIGS. 31 and 32 and so parts common to these two embodiments will be given the same reference numerals and will not be described in detail. In this embodiment, the magnet 104 is held by the membrane 101 aligned in a radial direction relative to the axis of the associated casing 11. As the plug 106 is passed through the casing 11, the magnet 107 causes the chamber magnet 104 to rotate (see FIG. 34) so breaking the membrane 101. The chemicals 102,103 then mix and expand as before, so releasing the band extremities 37*a*, 37*b*.

Finally, referring to FIGS. 35 and 36, the arrangement of these Figures has parts in common with the arrangement of FIGS. 31 and 32. Again, parts common to these Figures will be given the same reference numerals and will not be described in detail.

In this embodiment, the chamber magnet 104 is not moved by the plug. Rather, a wire line tool 108 is passed through the casing 11 which generates a strong magnetic field. This is sufficient to attract the chamber magnet 104 so breaking the membrane 101 and releasing the chemicals 102, 103, as before. The wire line tool 108 can also sense actuation of the chamber magnet 104 and release of the band 14, and can pass a corresponding signal to the surface.

In a very simple embodiment the ends of the band 14 could be held together by a pin which could be connected to wire leading to the top of the bore. Pulling on the wire would release the pin and allow the springs of the centralizer to expand against the side of the bore.

It will be appreciated that in, for example the embodiment shown in FIGS. 13 to 17, the member 12 need not be a spring but could simply comprise a strip of metal which bowed outwardly against the side of the bore on movement of the energizing device 23. In such an embodiment band 17 would not be necessary although a small outward bend in member 12 would be advantageous to facilitate bowing.

We claim:

1. A centralizer for well casings, said centralizer comprising, a mounting means by which the centralizer may be mounted on an outer surface of a casing, a plurality of members carried by the mounting means at spaced positions therearound, the members held by a control device in a collapsed position in which the members extend along said casing closely adjacent said outer surface thereof, said control device actuatable so that the members move from said collapsed position to a deployed position in which the members extend away from said mounting means for engagement with an associated borehole, and said control device is actuable when said casing is disposed in said borehole, said control device disposable wholly radially outwardly or wholly radially inwardly of said casing, each member resiliently biased towards said deployed position, the control device holding the members in said collapsed position, each member comprising a spring strip whose inherent resilience provides resilient bias to bias each member toward said deployed position, the mounting means including two spaced annular sleeves, the ends of each spring strip connected to respective sleeves so that, in said deployed position, the spring strips bow outwardly between said sleeves, and the control device comprising a band extending around said spring strips and holding said spring strips in said collapsed position against said resilient bias, said band releasable to allow movement of said spring strips to said deployed position.

2. A centralizer according to claim 1 characterized in that the band is held by a part which is chemically degradable to release said band.

3. A centralizer according to 1 wherein the control device comprises at least one pair of struts which are hinged together at a hinged connection and which, at ends opposite said hinged connection are pivotally connected to respective sleeves, the struts releasably held in a position in which spacing between said sleeves is a maximum to maintain said spring strips in said collapsed position, release of said struts causing said struts to pivot as the spring strips move to said deployed position and to cause the spacing of the sleeves to decrease from said maximum.

4. A centralizer according to claim 3 characterized in that the struts are held by a part which is chemically degradable to release said struts.

5. A centralizer according to claim 2 characterized in that the part is of titanium and said chemical is hydrofluoric acid.

6. A centralizer according to claim 3 characterized in that a pair of struts is provided for each spring strip.

7. A centralizer according to claim 4 characterized in that the resilient bias of the spring strips moves said spring strips to a first deployed position in which said spring strips have a first spacing from an associated casing outer surface, and an energizing device provided to move said spring strips to a second deployed position in which said spacing is increased.

8. A centralizer according to claim 7 characterized in that two sleeves are provided with the spring strips extending between said sleeves, one sleeve being attached to an associated casing with the other sleeve being unattached, a strut being connected at one end to said other sleeve and engaging, towards an end opposite said one end, said energizer device, the energizer device operable when the spring strips are in the first deployed position to move the strut to cause the other sleeve to move closer to the first sleeve so causing increased bowing of the spring strips to said second deployed position.

9. A centralizer according to claim 8 characterized in that the energizer device comprises a hydraulic device in communication with the interior of an associated casing and operated by high pressure fluid from the interior of the casing.

10. A centralizer according to claim 1 characterized in that the band is guided around the centralizer on inward sides of the spring strips and extremities of the band are held by a locking device to hold the spring strips in the collapsed position, the extremities releasable from the locking device at a predetermined point within the borehole to allow the spring strips to adopt the deployed position.

11. A centralizer according to claim 10 characterized in that guiding elements for holding and guiding the band are situated on the inward side of the spring strips.

12. A centralizer according to claim 10 characterized in that the locking device comprises a pressure element with a piston housed therein having a pin releasablly engaged in an opening of one of the band extremities, the piston normally in an operative position in which the pin engages the band extremity and the piston movable from said operative position to release the pin from the band extremity and so release the band.

13. A centralizer according to claim 12 characterized in that the pressure element comprises a cylindrical casing carrying a cover having a central opening through which the piston pin projects outwards and into the opening of an extremity of the band, the extremities of the band located between the cover and a holding plate which is fastened on the cover and which is provided with a central opening for reception of the piston pin.

14. A centralizer according to claim 12 characterized in that the pressure element is provided with openings to allow ambient atmosphere to act on one side of the piston to move the piston from the operative position.

15. A centralizer according to claim 12 characterized in that the piston is biased into said operative position by means of a pressurized gas.

16. A centralizer according to claim 12 characterized in that the piston is biased into said operative position by means of a mechanical spring.

17. A centralizer according to claim 16 characterized in that the pressure element is connected to a control pressure duct for providing fluid under pressure to a piston side facing away from the piston spring to move the piston from the operative position.

18. A centralizer according to claim 15 characterized in that the pressure element is provided with a heating resistance to control the temperature of a working fluid present therein, heating of the fluid moving the piston from said operative position.

19. A centralizer according to claim 15 characterized in that the pressure element is provided with outlet openings and includes a liquefiable working substance of solid consistency, removable via drain holes from the pressure element, liquefaction of the working substance moving the piston from the operative position.

20. A centralizer according to claim 16 characterized in that the piston is movable to an inoperative position against the force of the spring by means of a lever mechanism.

21. A centralizer according to claim 20 characterized in that the piston is provided with a piston rod which extends outwards through a central opening of the pressure element and is movably coupled with a lever supported on a rear wall of the element, a free end of the lever being acted upon by a traction element operable from a surface above the borehole.

22. A centralizer according to claim 21 characterized in that the traction element extends through a loop formed at said free end of the lever, an end of the element carries a shaped member which, on operation of the traction element engages the loop to pivot the lever and moves the piston from the operative position.

23. A centralizer according to claim 10 characterized in that the locking device is provided with a parting tool for releasing the band.

24. A centralizer according to claim 23 characterized in that the extremities of the band are fixedly joined to a plate which carries a pivotable cutting tool provided with a traction element for operating the cutting tool to cut the band and so release the spring strips.

25. A centralizer according to claim 12 characterized in that the piston is provided with a piston rod extending outwards through a central opening of the element, to which is attached one end of a traction cable, an other end of the traction cable being fixedly joined to a fastening ring installed on a casting carrying the centralizer so that relative rotation of the centralizer and the casing moves the piston from the operative position.

26. A centralizer according to claim 1 characterized in that extremities of the band are held together by a wrap to maintain the spring strips in the collapsed position, a conductive wire extending through the wrap and connected at one end to one part of an electrical battery, an other end of the wire connected to a magnet located adjacent a terminal of the other part of the battery, passage of a fluid containing magnetic conductive particles past the band causing said particles to be attached to the magnet to form a conductive path between the wire and the other battery part so causing the conductive wire to heat the wire and separate the wrap so allowing the spring strips to move to the deployed position.

27. A centralizer according to claim 1 characterized in that the band has two extremities, each extremity associated with a respective chamber part which cooperate together to form a closed chamber, the chamber divided by a membrane with one division containing a first substance and the other division containing a second substance, means being provided for breaking the membrane so allowing the substance to mix, the substances being such that, on mixing, the volume thereof increases so separating the chamber parts and allowing the spring strips to move to the deployed position.

28. A centralizer according to claim 27, wherein said means is a magnet carried by the membrane, the membrane being broken by movement of the magnet under the action of an applied magnetic force.

29. A centralizer for well casings disposable in a borehole said centralizer comprising mounting means by which the centralizer is mounted on an outer surface of a casing disposable in a borehole, a plurality of members carried by the mounting means at spaced positions therearound, a control device holding the members in a collapsed position in which the members extend along said casing closely adjacent said outer surface thereof, said control device actutable when the casing is disposed in a borehole without contacting an interior of the borehole so that the members move from said collapsed position to a deployed position in which the members extend away from said mounting means for engagement with the borehole.

* * * * *